US010502093B2

(12) United States Patent
Synnott et al.

(10) Patent No.: US 10,502,093 B2
(45) Date of Patent: Dec. 10, 2019

(54) TURBINE SHROUD COOLING

(71) Applicant: PRATT & WHITNEY CANADA CORP., Longueuil (CA)

(72) Inventors: Remy Synnott, St-Jean-sur-Richelieu (CA); Mohammed Ennacer, St-Hubert (CA); Chris Pater, Longueuil (CA); Denis Blouin, Ste-Julie (CA); Kapila Jain, Kirkland (CA); Farough Mohammadi, Montreal (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 148 days.

(21) Appl. No.: 15/840,492

(22) Filed: Dec. 13, 2017

(65) Prior Publication Data

US 2019/0178102 A1 Jun. 13, 2019

(51) Int. Cl.

| | |
|---|---|
| ***F01D 11/24*** | (2006.01) |
| ***F01D 25/12*** | (2006.01) |
| ***F01D 5/18*** | (2006.01) |
| ***F01D 5/22*** | (2006.01) |
| ***F01D 5/08*** | (2006.01) |

(52) U.S. Cl.

CPC ..... *F01D 25/12* (2013.01); *F01D 5/081* (2013.01); *F01D 5/185* (2013.01); *F01D 5/225* (2013.01); *F05D 2260/201* (2013.01); *F05D 2260/205* (2013.01)

(58) Field of Classification Search

CPC ..... F01D 25/12; F01D 5/081; F01D 5/185; F01D 5/225; F01D 5/187; F01D 9/06; F01D 11/005; F01D 5/188; F05D 2260/201; F05D 2260/205; F05D 2240/11; F05D 2240/81; F05D 2260/20

USPC ..... 415/173.1

See application file for complete search history.

(56) References Cited

U.S. PATENT DOCUMENTS

| | | | | |
|---|---|---|---|---|
| 2,700,530 A * | 1/1955 | Williams | F01D 5/187 | 415/115 |
| 3,527,544 A * | 9/1970 | Allen | F01D 5/187 | 416/90 R |
| 3,689,174 A * | 9/1972 | Rahaim | F01D 5/18 | 415/115 |
| 3,831,258 A * | 8/1974 | Elbert | B22F 7/04 | 428/592 |
| 4,137,619 A * | 2/1979 | Beltran | B22F 5/04 | 29/889.722 |

(Continued)

*Primary Examiner* — Justin D Seabe
*Assistant Examiner* — Brian Christopher Delrue
(74) *Attorney, Agent, or Firm* — Norton Rose Fulbright Canada LLP

(57) ABSTRACT

A turbine shroud segment has a body extending axially between a leading edge and a trailing edge and circumferentially between a first and a second lateral edge. A core cavity is defined in the body and extends axially from a front end adjacent the leading edge to a rear end adjacent to the trailing edge. A plurality of cooling inlets and outlets are respectively provided along the front end and the rear end of the core cavity. A crossover wall extends across the core cavity and defines a row of crossover holes configured to accelerate the flow of coolant directed into the core cavity via the cooling inlets. The crossover wall is positioned to accelerate the coolant flow at the beginning of the cooling scheme where the shroud segment is the most thermally solicited.

17 Claims, 5 Drawing Sheets

(56) References Cited

U.S. PATENT DOCUMENTS 4,383,854 A * 5/1983 Dembowski ..... B22F 5/04 419/1
4,526,226 A * 7/1985 Hsia ..... F01D 5/187 165/109.1
4,573,865 A * 3/1986 Hsia ..... F01D 5/187 165/109.1
4,604,780 A * 8/1986 Metcalfe ..... B23P 15/04 228/159
4,616,976 A * 10/1986 Lings ..... F01D 5/186 415/114
4,871,621 A * 10/1989 Bagley ..... B22F 3/22 428/549
5,010,050 A * 4/1991 Wullenweber ..... B22F 3/1118 502/301
5,092,735 A * 3/1992 Katy ..... F01D 11/08 415/115
5,127,793 A * 7/1992 Walker ..... F01D 11/08 415/115
5,130,084 A * 7/1992 Matheny ..... B22F 3/1275 419/8
5,165,847 A * 11/1992 Proctor ..... F01D 11/08 415/115
5,375,973 A * 12/1994 Sloop ..... F01D 11/08 415/115
5,486,090 A * 1/1996 Thompson ..... F01D 11/08 415/173.1
5,488,825 A * 2/1996 Davis ..... F01D 5/187 415/115
5,533,864 A * 7/1996 Nomoto ..... F01D 5/186 415/115
5,538,393 A * 7/1996 Thompson ..... F01D 11/08 415/115
5,553,999 A * 9/1996 Proctor ..... F01D 11/08 415/134
5,574,957 A * 11/1996 Barnard ..... B22F 3/22 419/10
5,772,748 A * 6/1998 Hubbard ..... B22F 3/1291 106/38.27
5,933,699 A * 8/1999 Ritter ..... B23P 15/00 419/28
5,950,063 A * 9/1999 Hens ..... B22F 1/0059 419/36
5,993,150 A * 11/1999 Liotta ..... F01D 11/10 415/115
6,102,656 A * 8/2000 Nissley ..... C23C 4/02 415/174.4
6,126,389 A * 10/2000 Burdgick ..... F01D 11/24 415/115
6,139,257 A * 10/2000 Proctor ..... F01D 9/04 415/115
6,170,831 B1 * 1/2001 Bouchard ..... F01D 11/005 277/355
6,196,799 B1 * 3/2001 Fukue ..... F01D 5/186 416/97 R
6,217,282 B1 * 4/2001 Stanka ..... F01D 9/042 415/209.2
6,254,334 B1 * 7/2001 LaFleur ..... F01D 5/186 415/115
6,350,404 B1 * 2/2002 Li ..... B28B 1/265 264/635
6,354,795 B1 * 3/2002 White ..... F01D 11/24 415/116
6,547,210 B1 * 4/2003 Marx ..... B22F 3/225 249/175
6,595,750 B2 * 7/2003 Parneix ..... F01D 5/187 416/97 R
6,612,806 B1 * 9/2003 Bolms ..... F01D 25/12 415/115
6,679,680 B2 * 1/2004 Um ..... B23K 1/0008 415/173.1
6,709,771 B2 * 3/2004 Allister ..... B22F 5/04 148/527
6,776,955 B1 * 8/2004 Lim ..... B22F 3/1283 419/36
6,857,848 B2 * 2/2005 Fokine ..... F01D 11/005 415/116
6,874,562 B2 * 4/2005 Knott ..... B22D 17/00 164/113
6,910,854 B2 * 6/2005 Joslin ..... F01D 5/225 415/139
6,939,505 B2 * 9/2005 Musso ..... C04B 38/0006 257/E23.099
6,974,308 B2 * 12/2005 Halfmann ..... B22C 9/04 415/115
7,007,488 B2 * 3/2006 Orlando ..... F01D 9/065 60/782
7,029,228 B2 * 4/2006 Chan ..... F01D 9/041 415/1
7,052,241 B2 * 5/2006 Decker ..... B22F 5/04 416/213 R
7,114,920 B2 * 10/2006 Synnott ..... F01D 9/02 415/173.1
7,128,522 B2 * 10/2006 Jutras ..... F01D 11/006 415/1
7,175,387 B2 * 2/2007 Kreis ..... F01D 5/22 277/628
7,217,081 B2 * 5/2007 Scheurlen ..... F01D 11/008 415/1
7,234,920 B2 * 6/2007 Imbourg ..... B22F 3/15 29/889.2
7,270,175 B2 * 9/2007 Mayer ..... F01D 25/08 165/170
7,306,424 B2 * 12/2007 Romanov ..... F01D 11/08 415/115
7,407,622 B2 * 8/2008 Voice ..... B22F 5/04 419/48
7,513,040 B2 * 4/2009 Cunha ..... B23P 15/00 164/516
7,517,189 B2 * 4/2009 Camus ..... F01D 9/04 415/173.1
7,621,719 B2 * 11/2009 Lutjen ..... F01D 9/06 415/173.1
7,625,178 B2 * 12/2009 Morris ..... F01D 5/187 29/889.7
7,665,962 B1 * 2/2010 Liang ..... F01D 11/24 415/173.1
7,687,021 B2 * 3/2010 Imbourg ..... B22F 3/1258 29/889.2
7,704,039 B1 * 4/2010 Liang ..... F01D 9/04 415/116
7,722,315 B2 * 5/2010 Lee ..... F01D 11/08 415/115
7,740,442 B2 * 6/2010 Lee ..... F01D 9/04 415/1
7,785,067 B2 * 8/2010 Lee ..... F01D 9/04 415/116
7,857,581 B2 * 12/2010 Mons ..... B23H 9/10 277/415
7,875,340 B2 * 1/2011 Cho ..... B82Y 10/00 174/256
8,043,059 B1 * 10/2011 Liang ..... F01D 5/187 416/96 R
8,246,298 B2 * 8/2012 Wilson ..... F01D 21/003 415/116
8,313,301 B2 * 11/2012 Hudson ..... B22C 9/103 416/191
8,366,383 B2 * 2/2013 Thibodeau ..... B22C 9/10 415/116
8,388,300 B1 * 3/2013 Liang ..... F01D 11/08 415/1
8,439,634 B1 * 5/2013 Liang ..... F01D 11/10 415/115
8,449,246 B1 * 5/2013 Liang ..... F01D 9/04 415/115
8,459,934 B2 * 6/2013 Hofmann ..... F01D 5/147 415/115
8,475,121 B1 * 7/2013 Liang ..... F01D 5/288 415/115

(56) References Cited

U.S. PATENT DOCUMENTS 8,596,962 B1 * 12/2013 Liang ..... F01D 11/08 415/116
8,596,963 B1 * 12/2013 Liang ..... F01D 11/12 29/889.22
8,727,704 B2 * 5/2014 Lee ..... F01D 11/08 415/116
8,814,507 B1 * 8/2014 Campbell ..... F01D 5/08 415/173.1
8,985,940 B2 * 3/2015 Zhang ..... F01D 5/081 415/115
9,028,744 B2 * 5/2015 Durocher ..... B22F 3/225 419/5
9,080,458 B2 * 7/2015 Romanov ..... F01D 11/08
9,238,970 B2 * 1/2016 Thibodeau ..... F01D 11/001
9,611,754 B2 * 4/2017 Taylor ..... F01D 11/08
9,677,412 B2 * 6/2017 Jones ..... F01D 11/24
9,689,273 B2 * 6/2017 Jones ..... F01D 11/08
9,784,125 B2 * 10/2017 Duguay ..... F01D 25/12
9,896,951 B2 * 2/2018 Facchinetti ..... F01D 5/189
9,920,647 B2 * 3/2018 Jones ..... F01D 11/24
9,926,799 B2 * 3/2018 Romanov ..... F01D 11/08
10,107,128 B2 * 10/2018 Romanov ..... F01D 11/08
10,174,622 B2 * 1/2019 Zhang ..... F01D 5/187
2002/0182057 A1 * 12/2002 Liotta ..... F01D 9/041 415/115
2003/0031555 A1 * 2/2003 Noe ..... F01D 5/189 415/115
2003/0035722 A1 * 2/2003 Barrett ..... F01D 9/04 415/200
2003/0131980 A1 * 7/2003 DeMarche ..... F01D 11/24 165/169
2004/0001753 A1 * 1/2004 Tiemann ..... F01D 5/187 416/97 R
2004/0141838 A1 * 7/2004 Thompson ..... F01D 11/08 415/209.3
2005/0111965 A1 * 5/2005 Lowe ..... F01D 9/04 415/116
2005/0214156 A1 * 9/2005 Troitski ..... B22F 3/1258 419/49
2005/0281663 A1 * 12/2005 Trindade ..... F01D 5/18 415/1
2006/0140753 A1 * 6/2006 Romanov ..... F01D 11/08 415/173.1
2007/0020087 A1 * 1/2007 Durocher ..... F01D 9/04 415/115
2007/0020088 A1 * 1/2007 Durocher ..... F01D 11/24 415/115
2007/0031240 A1 * 2/2007 Nichols ..... F01D 5/288 415/115
2007/0086883 A1 * 4/2007 Shapiro ..... F01D 11/08 415/115
2007/0154312 A1 * 7/2007 Neuhoff ..... F01D 5/187 416/97 R
2007/0237624 A1 * 10/2007 Nigmatulin ..... F01D 11/005 415/115
2007/0248462 A1 * 10/2007 Lutjen ..... F01D 9/06 416/95
2008/0005903 A1 * 1/2008 Trindade ..... B22C 21/14 29/889.2
2008/0089787 A1 * 4/2008 Abdel-Messeh ..... F01D 5/187 416/179
2008/0127491 A1 * 6/2008 Lee ..... F01D 11/08 29/888.02
2008/0131264 A1 * 6/2008 Lee ..... F01D 11/24 415/116
2008/0206042 A1 * 8/2008 Lee ..... F01D 5/143 415/116
2008/0211192 A1 * 9/2008 Pietraszkiewicz ..... F01D 11/08 277/347
2009/0123266 A1 * 5/2009 Thibodeau ..... B22C 9/10 415/110
2009/0129961 A1 * 5/2009 Lavoie ..... B22F 3/225 419/10
2009/0169368 A1 * 7/2009 Schlichting ..... F01D 11/122 415/173.1
2010/0014985 A1 * 1/2010 Jain ..... F01D 11/08 416/97 R
2010/0025001 A1 * 2/2010 Lee ..... B22C 7/02 164/23
2010/0040479 A1 * 2/2010 Spangler ..... F01D 11/006 416/97 R
2010/0232929 A1 * 9/2010 Joe ..... F01D 9/04 415/1
2011/0033331 A1 * 2/2011 Tuppen ..... B22F 3/093 419/8
2011/0247346 A1 * 10/2011 Kimmel ..... F01D 5/081 60/806
2011/0250560 A1 * 10/2011 Kwon ..... A61C 3/03 433/119
2011/0259017 A1 * 10/2011 Lacy ..... F01D 5/186 60/806
2012/0186768 A1 * 7/2012 Sun ..... B22C 7/02 164/23
2012/0189426 A1 * 7/2012 Thibodeau ..... F01D 11/08 415/1
2012/0219401 A1 * 8/2012 Rawlinson ..... F01D 11/122 415/115
2012/0219404 A1 * 8/2012 Weber ..... F01D 9/04 415/173.1
2013/0017058 A1 * 1/2013 Joe ..... F01D 11/08 415/1
2013/0028704 A1 * 1/2013 Thibodeau ..... F01D 11/24 415/1
2013/0051972 A1 * 2/2013 Romanov ..... F01D 11/08 415/1
2013/0051979 A1 * 2/2013 Durocher ..... F01D 9/04 415/115
2013/0052074 A1 * 2/2013 Durocher ..... B22F 3/225 419/5
2013/0071227 A1 * 3/2013 Thibodeau ..... F01D 11/001 415/1
2013/0170963 A1 * 7/2013 Mironets ..... F01D 11/12 415/173.1
2013/0192257 A1 * 8/2013 Horine ..... F01D 11/08 60/796
2013/0205791 A1 * 8/2013 Mongillo, Jr. ..... F01D 5/186 60/754
2013/0205793 A1 * 8/2013 Xu ..... F23R 3/06 60/754
2013/0205794 A1 * 8/2013 Xu ..... F01D 5/186 60/754
2013/0205801 A1 * 8/2013 Xu ..... F01D 5/186 60/806
2013/0205802 A1 * 8/2013 Levasseur ..... F01D 5/186 60/806
2013/0206739 A1 * 8/2013 Reed ..... F01D 25/12 219/121.71
2013/0209233 A1 * 8/2013 Xu ..... F01D 5/186 415/116
2013/0216363 A1 * 8/2013 Blaney ..... F01D 11/24 415/177
2013/0323032 A1 * 12/2013 Lutjen ..... F04D 29/164 415/173.1
2013/0323033 A1 * 12/2013 Lutjen ..... F01D 11/08 415/173.1
2013/0327854 A1 * 12/2013 Davis, III ..... F01D 9/041 239/589
2013/0340966 A1 * 12/2013 Tholen ..... B22C 9/103 164/6
2014/0047843 A1 * 2/2014 Papple ..... F01D 5/187 60/726
2014/0064913 A1 * 3/2014 Adavikolanu ..... F01D 11/24 415/1
2014/0064969 A1 * 3/2014 Romanov ..... F01D 11/08 416/174
2014/0086724 A1 * 3/2014 Tibbott ..... F01D 5/187 415/1

(56) References Cited

U.S. PATENT DOCUMENTS

2014/0140860 A1* 5/2014 Tibbott ..... F01D 5/188 416/97 R
2014/0157792 A1* 6/2014 Itzel ..... F01D 9/041 60/806
2014/0219815 A1* 8/2014 Kohli ..... F01D 5/18 416/97 R
2014/0294560 A1* 10/2014 Mishra ..... F01D 11/24 415/1
2014/0360155 A1* 12/2014 Weber ..... F01D 5/187 60/39.83
2015/0007581 A1* 1/2015 Sezer ..... F01D 11/24 60/806
2015/0086381 A1* 3/2015 Papple ..... F01D 5/187 416/97 R
2015/0093281 A1* 4/2015 Campomanes ..... B22F 3/225 419/38
2015/0226085 A1* 8/2015 Spangler ..... F01D 25/12 60/806
2015/0308274 A1* 10/2015 Philbrick ..... F01D 5/187 165/51
2015/0322799 A1* 11/2015 Xu ..... F01D 5/18 416/231 R
2015/0322860 A1* 11/2015 Slavens ..... F01D 9/02 60/806
2015/0377029 A1* 12/2015 Blake ..... F01D 5/187 416/232
2016/0010467 A1* 1/2016 Lamson ..... F01D 5/187 60/772
2016/0017750 A1* 1/2016 Lefebvre ..... F01D 25/12 415/175
2016/0024966 A1* 1/2016 Campomanes ..... F01D 25/14 419/5
2016/0069189 A1* 3/2016 Quach ..... B22C 9/103 416/241 B
2016/0084167 A1* 3/2016 Birnkrant ..... G05D 23/021 60/754
2016/0121389 A1* 5/2016 Slavens ..... B22F 5/009 164/9
2016/0123186 A1* 5/2016 Stover ..... F01D 11/24 415/116
2016/0160760 A1* 6/2016 Romanov ..... F02C 7/18 60/772
2016/0169001 A1* 6/2016 Thornton ..... F01D 5/187 416/95
2016/0169016 A1* 6/2016 Blaney ..... F01D 9/065 415/115
2016/0177733 A1* 6/2016 Lewis ..... F01D 5/186 416/95
2016/0177737 A1* 6/2016 Musto ..... F01D 5/186 415/115
2016/0186660 A1* 6/2016 Bergholz ..... F02C 7/18 416/95
2016/0194967 A1* 7/2016 Xu ..... F01D 5/188 416/95
2016/0194980 A1* 7/2016 Thomen ..... F04D 29/542 415/1
2016/0201474 A1* 7/2016 Slavens ..... F01D 5/186 60/806
2016/0251966 A1* 9/2016 Bunker ..... F01D 5/145 416/97 R
2016/0251967 A1* 9/2016 Bunker ..... F01D 5/186 416/95
2016/0251968 A1* 9/2016 Quach ..... F01D 5/187 60/754
2016/0305262 A1* 10/2016 Durocher ..... B22F 5/009
2016/0376906 A1* 12/2016 O'Leary ..... F01D 11/10 415/173.1
2016/0376907 A1* 12/2016 O'Leary ..... F01D 11/12 415/173.3
2016/0376921 A1* 12/2016 O'Leary ..... F01D 25/12 415/116
2017/0234151 A1* 8/2017 Spangler ..... F01D 5/188 415/115
2019/0145267 A1* 5/2019 Smith ..... F01D 5/187 416/1
2019/0178103 A1* 6/2019 Synnott ..... F01D 25/12
2019/0218925 A1* 7/2019 Garay ..... F01D 9/065

* cited by examiner

TURBINE SHROUD COOLING

TECHNICAL FIELD

The application relates generally to turbine shrouds and, more particularly, to turbine shroud cooling.

BACKGROUND OF THE ART

Turbine shroud segments are exposed to hot gases and, thus, require cooling. Cooling air is typically bled off from the compressor section, thereby reducing the amount of energy that can be used for the primary purposed of proving trust. It is thus desirable to minimize the amount of air bleed of from other systems to perform cooling. Various methods of cooling the turbine shroud segments are currently in use and include impingement cooling through a baffle plate, convection cooling through long EDM holes and film cooling.

Although each of these methods have proven adequate in most situations, advancements in gas turbine engines have resulted in increased temperatures and more extreme operating conditions for those parts exposed to the hot gas flow.

SUMMARY

In one aspect, there is provided a turbine shroud segment for a gas turbine engine having an annular gas path extending about an engine axis, the turbine shroud segment comprising: a body extending axially between a leading edge and a trailing edge and circumferentially between a first and a second lateral edge; a core cavity defined in the body and extending axially from a front end adjacent the leading edge to a rear end adjacent to the trailing edge; a plurality of cooling inlets along the front end of the core cavity; a plurality of cooling outlets along the rear end of the core cavity; and a crossover wall extending across the core cavity and defining a row of crossover holes configured to accelerate a flow of coolant delivered into the core cavity by the cooling inlets, the crossover wall being positioned axially closer to the cooling inlets than the cooling outlets.

In another aspect, there is provided a method of manufacturing a turbine shroud segment comprising: using a casting core to create an internal cooling circuit of the turbine shroud segment, the casting core having a body including a front portion connected to a rear portion by a transverse row of pins, the transverse row of pins including lateral pins positioned along opposed lateral edges of the body, the lateral pins having a greater cross-sectional area than that of the other pins of the transverse row of pins, and a plurality of holes defined through the front portion and the rear portion of the body of the casting core; casting a body of the turbine shroud segment about the casting core; and removing the casting core from the cast body of the turbine shroud segment.

DESCRIPTION OF THE DRAWINGS

Reference is now made to the accompanying figures in which.

DETAILED DESCRIPTION

Figure 1:
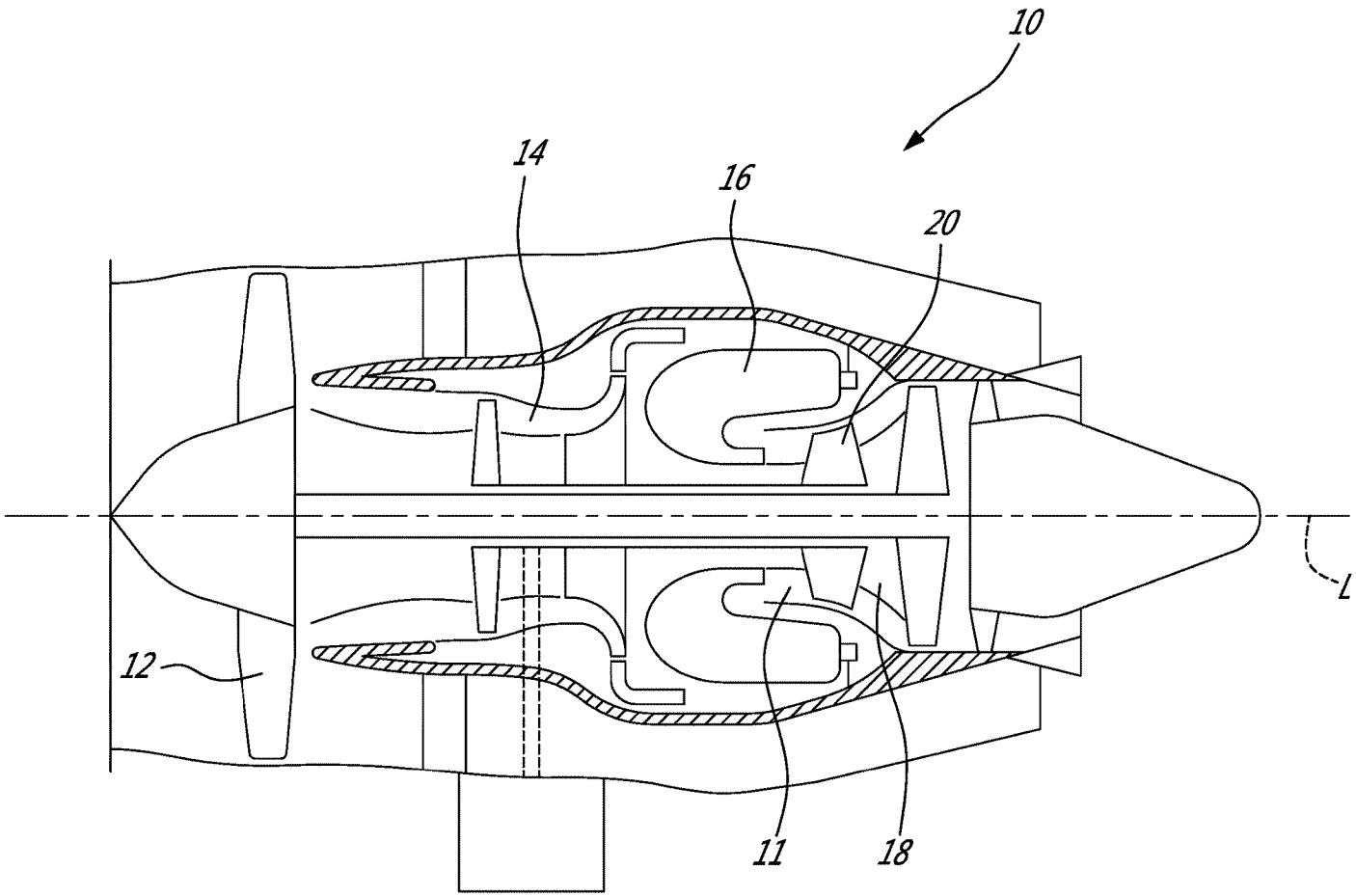
FIG. 1 is a schematic cross-sectional view of a gas turbine engine.

FIG. 1 illustrates a gas turbine engine 10 of a type preferably provided for use in subsonic flight, generally comprising an annular gas path 11 disposed about an engine axis L. A fan 12, a compressor 14, a combustor 16 and a turbine 18 are axially spaced in serial flow communication along the gas path 11. More particularly, the engine 10 comprises a fan 12 through which ambient air is propelled, a compressor section 14 for pressurizing the air, a combustor 16 in which the compressed air is mixed with fuel and ignited for generating an annular stream of hot combustion gases, and a turbine 18 for extracting energy from the combustion gases.

Figure 2:
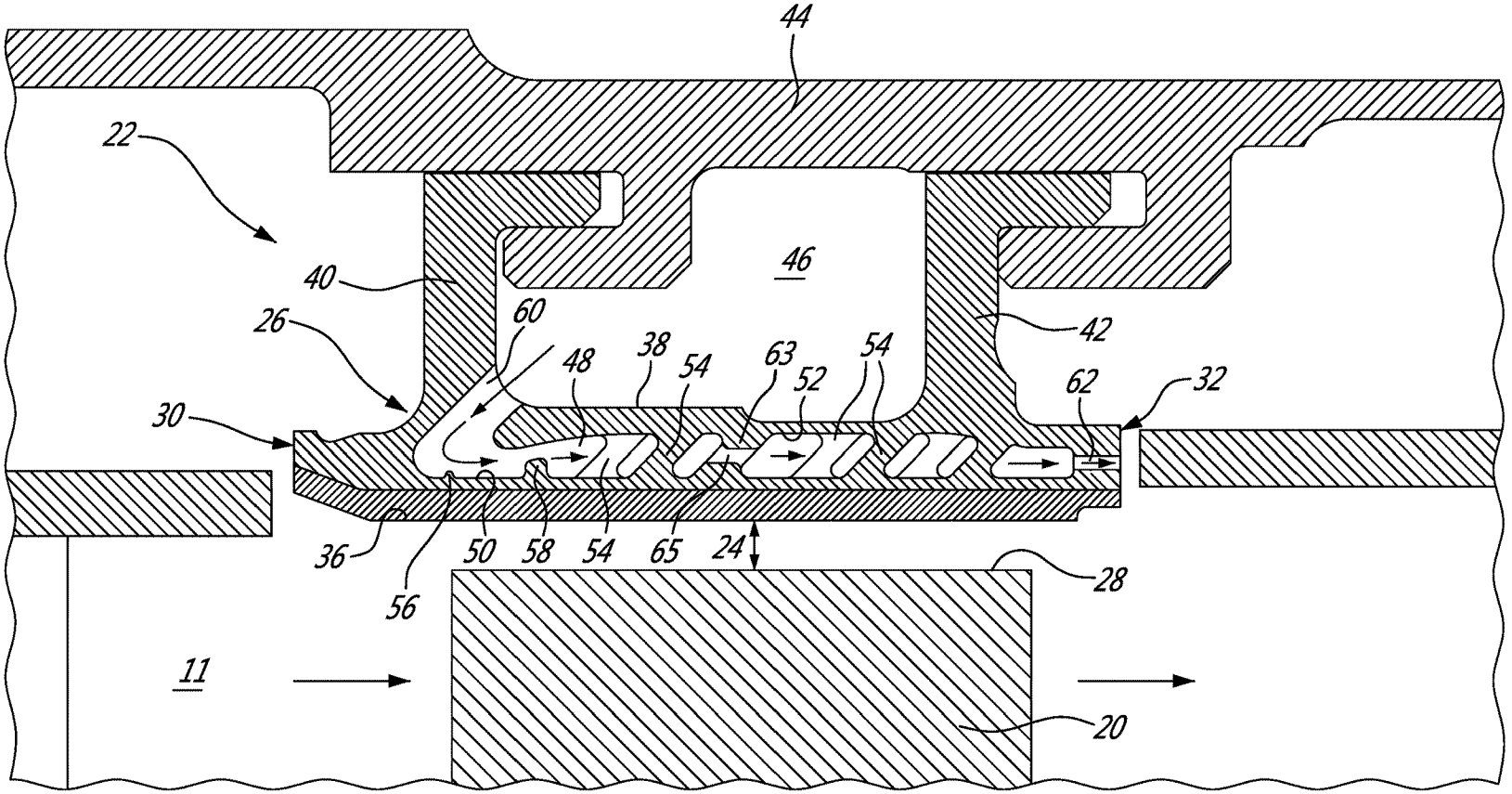
FIG. 2 is a schematic cross-section of a turbine shroud segment mounted radially outwardly in close proximity to the tip of a row of turbine blades of a turbine rotor.

As shown in FIG. 2, the turbine 18 includes turbine blades 20 mounted for rotation about the axis L. A turbine shroud 22 extends circumferentially about the rotating blades 20. The shroud 22 is disposed in close radial proximity to the tips 28 of the blades 20 and defines therewith a blade tip clearance 24. The shroud includes a plurality of arcuate segments 26 spaced circumferentially to provide an outer flow boundary surface of the gas path 11 around the blade tips 28.

Figure 3:
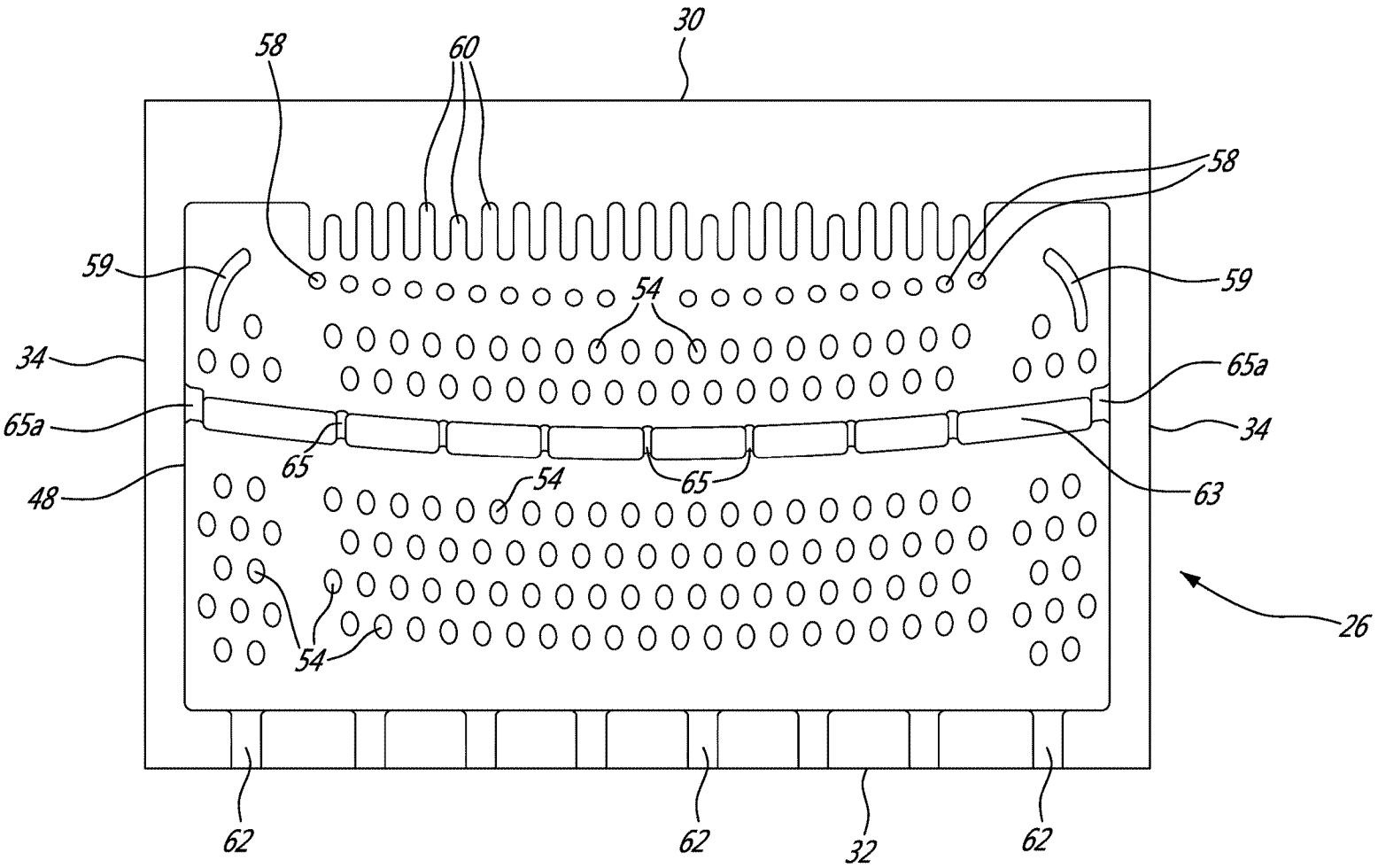
FIG. 3 is a plan view of a cooling scheme of the turbine shroud segment shown in FIG. 2.

Each shroud segment 26 has a monolithic cast body extending axially from a leading edge 30 to a trailing edge 32 and circumferentially between opposed axially extending sides 34 (FIG. 3). The body has a radially inner surface 36 (i.e. the hot side exposed to hot combustion gases) and a radially outer surface 38 (i.e. the cold side) relative to the engine axis L. Front and rear support legs 40, 42 (e.g. hooks) extend from the radially outer surface 38 to hold the shroud segment 26 into a surrounding fixed structure 44 of the engine 10. A cooling plenum 46 is defined between the front and rear support legs 40, 42 and the structure 44 of the engine 10 supporting the shroud segments 44. The cooling plenum 46 is connected in fluid flow communication to a source of coolant. The coolant can be provided from any suitable source but is typically provided in the form of bleed air from one of the compressor stages.

According to the embodiment illustrated in FIGS. 2 and 3, each shroud segment 26 has a single internal cooling scheme integrally formed in its body for directing a flow of coolant from a front or upstream end portion of the body of the shroud segment 26 to a rear or downstream end portion thereof. This allows to take full benefit of the pressure delta between the leading edge 30 (front end) and the trailing edge (the rear end). The cooling scheme comprises a core cavity 48 (i.e. a cooling cavity formed by a sacrificial core) extending axially from the front end portion of the body to the rear end portion thereof. In the illustrated embodiment, the core cavity 48 extends axially from underneath the front support leg 40 to a location downstream of the rear support leg 42 adjacent to the trailing edge. It is understood that the core cavity 48 could extend forwardly of the front support leg 40 towards the leading edge 30 of the shroud segment 26. In the circumferential direction, the core cavity 48 extends from a location adjacent a first lateral edge 34 of the shroud segment 26 to a location adjacent the second opposed lateral edge 34 thereof, thereby spanning the circumferential extent of the body of the shroud segment 26. In the radial direction, the core cavity 48 has a radial height which correspond to a predetermined radial thickness of the platform portion of the body. The core cavity 48 has a bottom surface 50 which corresponds to the back side of the radially inner surface 36 (the hot surface) of the shroud body and a top surface 52 corresponding to the inwardly facing side of the radially outer surface 38 (the cold surface) of the shroud body. The bottom and top surfaces 50, 52 of the core cavity 48 are integrally cast with the body of the shroud segment 26. The core cavity 48 is, thus, bounded by a monolithic body.

As shown in FIGS. 2 and 3, the core cavity 48 includes a plurality of pedestals 54 extending radially from the bottom wall 50 of the core cavity 48 to the top wall 52 thereof. As shown in FIG. 3, the pedestals 54 can be distributed in transversal rows with the pedestals 54 of successive rows being laterally staggered to create a tortuous path. The pedestals 54 are configured to disrupt the coolant flow through the core cavity 48 and, thus, increase heat absorption capacity. In addition to promoting turbulence to increase the heat transfer coefficient, the pedestals 54 increase the surface area capable to transferring heat from the hot side 36 of the turbine shroud segment 26, thereby proving more efficient and effective cooling. Accordingly, the cooling flow as the potential of being reduced. It is understood that the pedestals 54 can have different cross-sectional shapes. For instance, the pedestals 54 could be circular or oval in cross-section. The pedestals 54 are generally uniformly distributed over the surface the area of the core cavity 48. However, it is understood that the density of pedestals could vary over the surface area of the core cavity 48 to provide different heat transfer coefficients in different areas of the turbine shroud segment 26. In this way, additional cooling could be tailored to most thermally solicited areas of the shroud segments 26, using one simple cooling scheme from the front end portion to the rear end portion of the shroud segment 26. In use, this provides for a more uniform temperature distribution across the shroud segments 26.

As can be appreciated from FIG. 2, other types of turbulators can be provided in the core cavity 48. For instance, a row of trip strips 56 can be disposed upstream of the pedestals 54. It is also contemplated to provide a transversal row of stand-offs 58 between the strip strips 56 and the first row of pedestals 54. In fact, various combinations of turbulators are contemplated.

The cooling scheme further comprises a plurality of cooling inlets 60 for directing coolant from the plenum 46 into a front or upstream end of the core cavity 48. According to the illustrated embodiment, the cooling inlets 60 are provided as a transverse row of inlet passages along the front support leg 40. The inlet passages have an inlet end opening on the cooling plenum 46 just downstream (rearwardly) of the front support leg 40 and an outlet end opening to the core cavity 48 underneath the front support leg 40. As can be appreciated from FIG. 2, each inlet passage is angled forwardly to direct the coolant towards the front end portion of the shroud segment 26. That is each inlet passage is inclined to define a feed direction having an axial component pointing in an upstream direction relative to the flow of gases through the gas path 11. The angle of inclination of the cooling inlets 60 is an acute angle as measured from the radially outer surface 38 of the shroud segment 26. According to the illustrated embodiment, the inlets 60 are angled at about 45 degrees from the radially outer surface 38 of the shroud segment 26. If the inlet passages are formed by casting (they could also be drilled), the pedestals 54 may be configured to have the same orientation, including the same angle of inclination, as that of the as-cast inlet passages in order to facilitate the core de-molding operations. This can be appreciated from FIG. 2 wherein both the inlet passages and the pedestals are inclined at about 45 degrees relative to the bottom and top surfaces 50, 52 of the core cavity 48. As the combined cross-sectional area of the inlets 60 is small relative to that of the plenum 46, the coolant is conveniently accelerated as it is fed into the core cavity 48. The momentum gained by the coolant as it flows through the inlet passages contribute to provide enhance cooling at the front end portion of the shroud segment 26.

The cooling scheme further comprises a plurality of cooling outlets 62 for discharging coolant from the cavity core 48. As shown in FIG. 3, the plurality of outlets 62 includes a row of outlet passages distributed along the trailing edge 32 of the shroud segment 26. The trailing edge outlets 62 may be cast or drilled. They are sized to meter the flow of coolant discharged through the trailing edge 32 of the shroud segment 26. The cooling outlets 62 may comprise additional as-cast or drilled outlet passages. For instance, cooling passages (not shown) could be defined in the lateral sides 34 of the shroud body to purge hot combustion gases from between circumferentially adjacent shroud segments 26 or in the radially inner surface 36 of the shroud body to provide for the formation of a cooling film over the radially inner surface 36 of the shroud segments 26.

Referring to FIG. 3, it can be appreciated that the cooling scheme may also comprise a pair of turning vanes 59 in opposed front corners of the core cavity 48. The turning vanes are disposed immediately downstream of the inlets 60 and configured to cause the coolant to flow to the front corners of the cavity 48 and then along the lateral sides of the shroud body.

Now referring concurrently to FIGS. 2 and 3, it can be appreciated that the cooling scheme may further comprise a crossover wall 63. The crossover wall 63 is generally positioned in the region of the shroud body, which in use is the most thermally solicited. According to the illustrated example, this is at the beginning of the cooling scheme in the upstream or front half portion of the core cavity 48. From FIG. 3, it can be appreciated that the crossover wall 63 is positioned axially closer to the inlets 60 than to the outlets 62.

The crossover wall 63 comprises a plurality of laterally spaced-part crossover holes 65 to meter and accelerate the flow of coolant delivered into the downstream or rear portion of the core cavity 48. It is understood that the total cross area of the crossover holes 65 is less than that of the inlets 60 to provide the desired metering/accelerating function. That is the crossover wall 63 is the flow restricting feature of the cooling scheme. By so accelerating the coolant flow in the hottest areas of the shroud segment 26, more heat can be extracted from hottest areas and, thus a more uniform temperature distribution can be achieved throughout the body of the shroud segment 26 and that with the same amount of coolant.

According to one application, the hottest areas of the shroud segment 26 are along the side edges 34. As shown in FIG. 3, the crossover holes 65 can be configured to provide additional cooling at the side edges 34. More particularly, the row of crossover holes 65 can comprise two distinct sets of crossover holes, a first set including laterally outermost holes 65*a* positioned at the first and second lateral edges of the body, and a second set including intermediate holes 65 positioned between the laterally outermost holes 65*a*. The laterally outermost holes 65*a* are different than the intermediate holes 65 and are configured as race tracks to direct a flow of coolant in direct contact with an interior side of the lateral edges 34, whereas the intermediate holes 65 are configured as typical circular holes and positioned to direct the coolant in an area of the rear portion of the core cavity 48 intermediate between the first and second lateral edges 34. The laterally outermost holes 65*a* and the intermediate holes 65 may have a different cross-sectional area. In the illustrated embodiment, the laterally outermost holes 65*a* have a greater cross-sectional area than that of the intermediate holes 65. This can be achieved by changing the shape of the lateral holes 65*a*. For instance, the intermediate holes 65 can be circular and the lateral holes 65*a* can have an oval or rectangular (i.e. oblong) race track cross-sectional shape. The shape of lateral holes 65*a* can be selected to allow the same to be positioned directly at the interior side of the lateral edges 34 so that coolant flowing through the lateral holes 65*a* "sweeps" the interior side of the side edges 34.

Alternatively, the lateral holes 65*a* could be configured as impingement holes to cause coolant to impinge directly upon hot spot regions on the interior side of the lateral edges 34 of the shroud body. For instance, the lateral holes 65*a* could be angled with respect to the first and second lateral edges so as to define a feed direction aiming at the hottest area along the side edges of the shroud body.

From FIG. 3, it can also be appreciated that the plurality of pedestals 54 includes pedestals 54 upstream and downstream of the crossover wall 63. In the illustrated example, a greater number of pedestals are provided in the rear portion of the cavity 48 downstream of the crossover wall 63.

At least one embodiment of the cooling scheme thus provides for a simple front-to-rear flow pattern according to which a flow of coolant flows front a front portion to a rear portion of the shroud segment 26 via a core cavity 48 including a plurality of turbulators (e.g. pedestals) to promote flow turbulence between a transverse row of inlets 60 provided at the front portion of shroud body and a transverse row of outlets 62 provided at the rear portion of the shroud body. A crossover wall 63 may be strategically positioned in the core cavity 48 to accelerate and direct the coolant flow to the hottest areas of the shroud body. In this way, a single cooling scheme can be used to effectively and uniformly cool the entire shroud segment 26.

The shroud segments 26 may be cast via an investment casting process. In an exemplary casting process, a ceramic core C (see FIG. 4) is used to form the cooling cavity 48 (including the trip strips 56, the stand-offs 58 and the pedestals 54), the cooling inlets 60 as well as the cooling outlets 62. The core C is over-molded with a material forming the body of the shroud segment 26. That is the shroud segment 26 is cast around the ceramic core C. Once, the material has formed around the core C, the core C is removed from the shroud segment 26 to provide the desired internal configuration of the shroud cooling scheme. The ceramic core C may be leached out by any suitable technique including chemical and heat treatment techniques. As should be appreciated, many different construction and molding techniques for forming the shroud segments are contemplated. For instance, the cooling inlets 60 and outlets 62 could be drilled as opposed of being formed as part of the casting process. Also some of the inlets 60 and outlets 62 could be drilled while others could be created by corresponding forming structures on the ceramic core C. Various combinations are contemplated.

Figure 4:
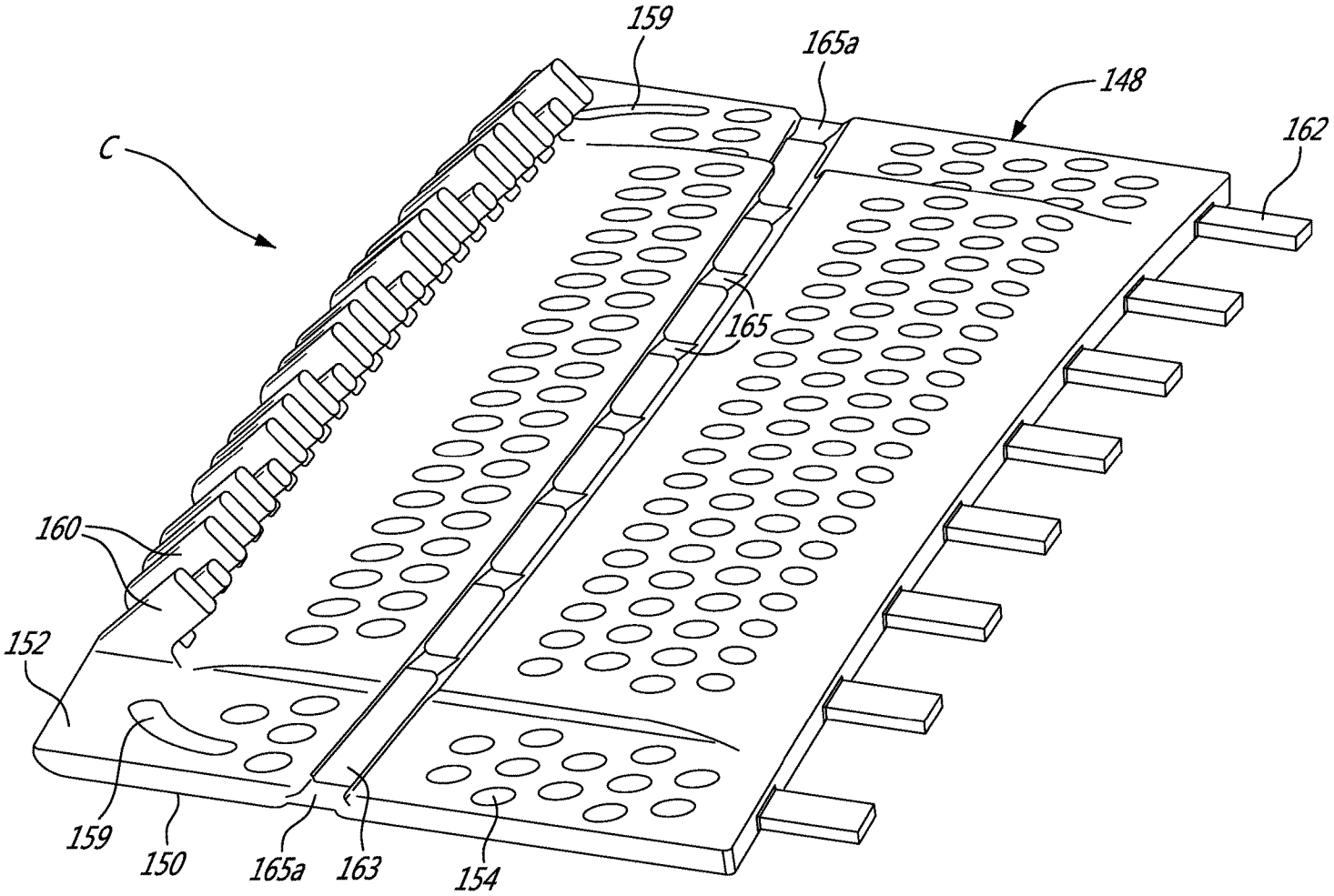
FIG. 4 is an isometric view of a casting core used to create the internal cooling scheme of the turbine shroud segment.

FIG. 4 shows an exemplary ceramic core C that could be used to form the core cavity 48 as well as as-cast inlet and outlet passages. The use of the ceramic core C to form at least part of the cooling scheme provides for better cooling efficiency. It may thus result in cooling flow savings. It can also result in cost reductions in that the drilling of long EDM holes and aluminide coating of long EDM holes are no longer required.

It should be appreciated that FIG. 4 actually shows a "mirror" of the cooling circuit of FIGS. 2 and 3. Notably, FIG. 4 includes reference numerals that are identical to those in FIGS. 2 and 3 but in the hundred even though what is actually shown in FIG. 4 is the casting core C rather than the actual internal cooling scheme. More particularly, the ceramic core C has a body 148 having opposed bottom and top surfaces 150, 152 extending axially from a front end to a rear end. The body 148 is configured to create the internal core cavity 48 in the shroud segment 26. A front transversal row of ribs 160 is formed along the front end of the ceramic core C. The ribs 160 extend at an acute angle from the top surface 152 of the ceramic core C towards the rear end thereof, thereby allowing for the creation of as-cast inclined inlet passages in the front end portion of the shroud segment 26. Slanted holes 154 are defined through the ceramic body 148 to allow for the creation of pedestals 154. Likewise recesses (not shown) are defined in the core body 148 to provide for the formation of the trip strips 56 and the stand-offs 58. The pedestal holes 154 have the same orientation as that of the ribs 160 to simplify the core die used to form the core itself. It facilitates de-moulding of the core and reduces the risk of breakage. According to one embodiment, the ribs 160 and the holes 154 are inclined at about 45 degrees from the top surface 152 of the ceramic body 148. The casting core C further comprises a row of projections 162, such as pins, extending axially rearwardly along the rear end of the ceramic body 148 between the bottom and top surfaces 150, 152 thereof. These projections 162 are configured to create as-cast outlet metering holes 62 in the trailing edge 32 of the shroud segment 26.

The core C has a front portion and a rear portion physically interconnected by a transverse row of pins 165, 165*a* used to form the crossover holes 65, 65*a* in the shroud segment. It can be appreciated from FIG. 4, that the outermost lateral pins 165*a* have a different cross-sectional shape than the intermediate pins 165. It can also be appreciated that the outermost pins 165*a* are larger than the intermediate pins 165. The outermost lateral pins 165*a* are provided along the lateral sides of the core C to allow for the formation of lateral crossover holes 65*a* at the very boundary of the core cavity 48.

Figure 5:
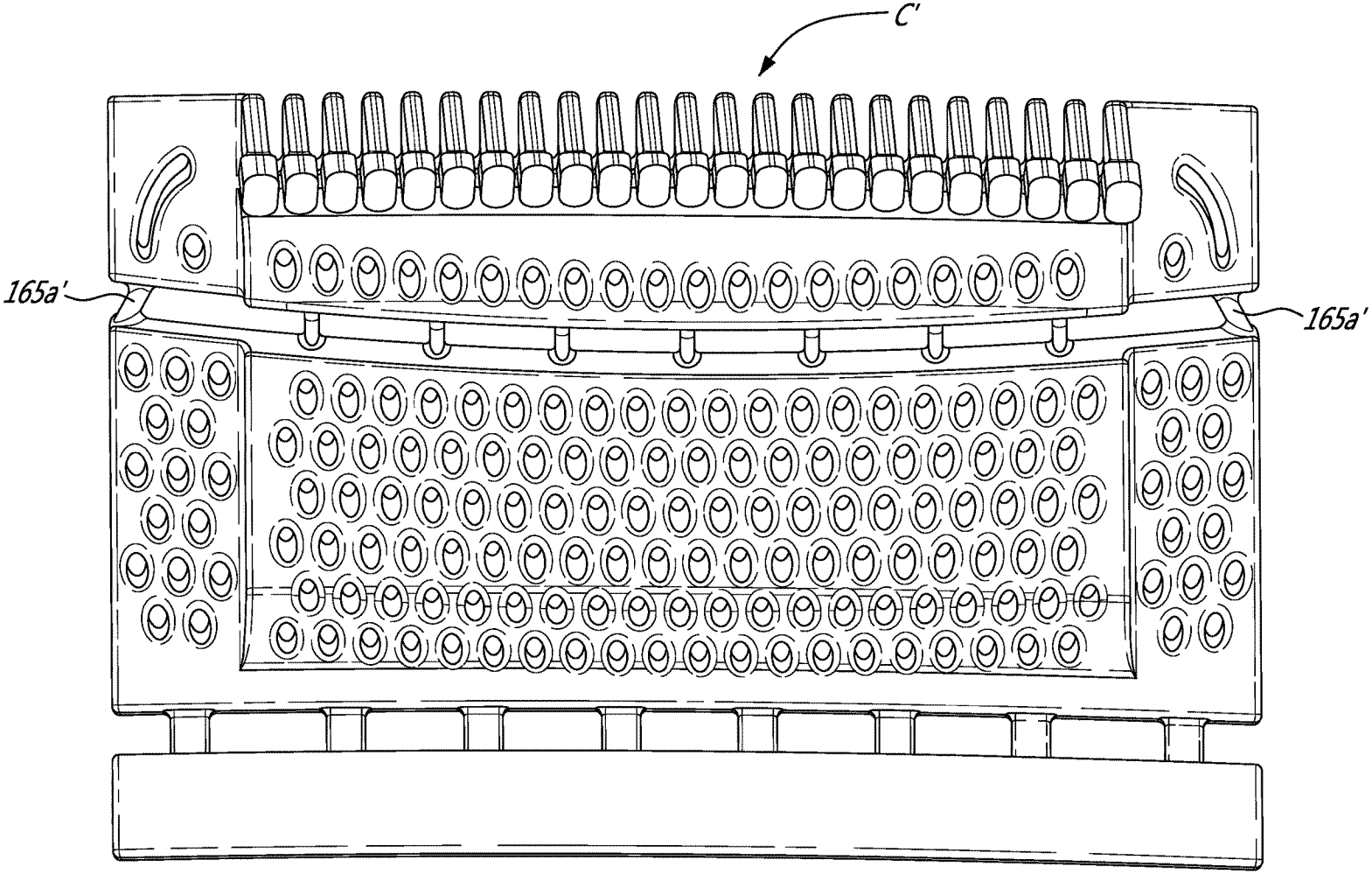
FIG. 5 is a plan view of another casting core including angled lateral crossover pins to provide for impingement cooling of hot spots on the lateral edges of the shroud body.

FIG. 5 illustrates another core C' which essentially differs from the core C shown in FIG. 4 in that the lateral crossover pins 165*a*' are angled laterally outwardly to form impingement holes in the shroud body for directing impingement jets directly against the hottest areas on the interior side of the lateral edges 34 of the shroud segment 26. The pins 165*a*' are oriented so that the corresponding impingement holes formed in the cast shroud body define a feed direction aiming at a hottest area along each lateral edge 34 of the shroud body.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. A turbine shroud segment for a gas turbine engine having an annular gas path extending about an engine axis, the turbine shroud segment comprising: a body extending axially between a leading edge and a trailing edge and circumferentially between a first and a second lateral edge; a core cavity defined in the body and extending axially from a front end adjacent the leading edge to a rear end adjacent to the trailing edge; a plurality of cooling inlets along the front end of the core cavity; a plurality of cooling outlets along the rear end of the core cavity; and a crossover wall extending across the core cavity and defining a row of crossover holes forming a constriction to accelerate a flow of coolant delivered into the core cavity by the cooling inlets, the crossover wall being positioned axially closer to the cooling inlets than the cooling outlets.

2. The turbine shroud segment defined in claim 1, wherein the row of crossover holes comprises two distinct sets of crossover holes, a first set including laterally outermost holes positioned at a boundary of the core cavity along the first and second lateral edges of the body, and a second set including intermediate holes positioned between the laterally outermost holes, the laterally outermost holes being configured to direct the coolant passing therethrough onto an interior side of the first and second lateral edges, the intermediate holes being configured to direct the coolant in an area of the core cavity intermediate between the first and second lateral edges of the body.

3. The turbine shroud segment defined in claim 2, wherein the laterally outermost holes and the intermediate holes have a different cross-sectional area.

4. The turbine shroud segment defined in claim 3, wherein the laterally outermost holes have a greater cross-sectional area than that of the intermediate holes.

5. The turbine shroud segment defined in claim 4, wherein the laterally outermost holes extend along the interior side of the first and second lateral edges and have a different cross-sectional shape than that of the intermediate holes.

6. The turbine shroud segment defined in claim 2, wherein the laterally outermost holes are impingement holes configured to cause coolant to impinge upon the interior side of the first and second lateral edges of the body.

7. The turbine shroud segment defined in claim 2, wherein the laterally outermost holes are angled with respect to the first and second lateral edges and define a feed direction aiming at a hottest area along the first and second lateral edges of the body.

8. The turbine shroud segment defined in claim 2, wherein the laterally outermost holes have an oblong cross-section, and wherein the intermediate holes have a circular cross-section.

9. The turbine shroud segment defined in claim 1, wherein the crossover holes have a smaller cross-sectional area than that of the plurality of cooling inlets.

10. The turbine shroud segment defined in claim 1, further comprising turning vanes in opposed corners of the front end of the core cavity.

11. The turbine shroud segment defined in claim 10, wherein the turning vanes are positioned upstream of the crossover wall relative to the flow of coolant though the core cavity.

12. The turbine shroud segment defined in claim 11, wherein the plurality of cooling inlets are inclined so as to define a feed direction having an axial component pointing in an upstream direction relative to the flow of coolant through the core cavity.

13. The turbine shroud segment defined in claim 1, further comprising a plurality of pedestals extending integrally from a bottom wall of the core cavity to a top wall thereof, the bottom wall corresponding to a back side of a radially inner wall of the body, the top wall corresponding to the back side of a radially outer wall of the body, the body being monolithic.

14. The turbine shroud segment defined in claim 13, wherein the plurality of pedestals includes a first set of pedestals positioned upstream of the crossover wall and a second set of pedestals positioned downstream of the crossover walls.

15. A method of manufacturing a turbine shroud segment comprising: using a casting core to create an internal cooling circuit of the turbine shroud segment, the casting core having a body including a front portion connected to a rear portion by a transverse row of pins, the transverse row of pins including lateral pins positioned along opposed lateral edges of the body, the lateral pins having a greater cross-sectional area than that of the other pins of the transverse row of pins, and a plurality of holes defined through the front portion and the rear portion of the body of the casting core; casting a body of the turbine shroud segment about the casting core; and removing the casting core from the cast body of the turbine shroud segment.

16. The method defined in claim 15, wherein the casting core further comprises a transverse row of ribs extending from a top surface of the front portion of the body of the casting core, and wherein the method comprises using the casting core to form as-cast inlet passages in a front portion of the turbine shroud segment.

17. The method defined in claim 15, wherein the casting core further comprises a transverse row of pins projecting from a rear end of the rear portion of the body of the casting core, and wherein the method comprises using the casting core to form as-cast outlet passages in a trailing edge of the turbine shroud segment.

* * * * *